US009511380B2

(12) United States Patent
Tiberghien et al.

(10) Patent No.: US 9,511,380 B2
(45) Date of Patent: Dec. 6, 2016

(54) COMPRESSED AIR GUN

(71) Applicant: STAUBLI FAVERGES, Faverges (FR)

(72) Inventors: Alain-Christophe Tiberghien, Sevrier (FR); Antoine Chambaud, Giez (FR)

(73) Assignee: STAUBLI FAVERGES, Faverges (FR)

( * ) Notice: Subject to any disclaimer, the term of this patent is extended or adjusted under 35 U.S.C. 154(b) by 0 days.

(21) Appl. No.: 14/663,631

(22) Filed: Mar. 20, 2015

(65) Prior Publication Data

US 2015/0273485 A1 Oct. 1, 2015

(30) Foreign Application Priority Data

Mar. 31, 2014 (FR) ..... 14 52825

(51) Int. Cl.

| | |
|---|---|
| ***B05B 7/02*** | (2006.01) |
| ***B05B 1/00*** | (2006.01) |
| ***B05B 15/06*** | (2006.01) |
| *B05B 12/02* | (2006.01) |
| *B05B 11/00* | (2006.01) |

(52) U.S. Cl.

CPC ..... *B05B 1/005* (2013.01); *B05B 15/061* (2013.01); *B05B 11/00* (2013.01); *B05B 12/02* (2013.01)

(58) Field of Classification Search

CPC ..... B05B 15/061; B05B 1/00; B05B 1/005; B05B 11/00; B05B 12/002

USPC ..... 239/525, 526, 586, 583

See application file for complete search history.

(56) References Cited

U.S. PATENT DOCUMENTS

| | | | | |
|---|---|---|---|---|
| 4,124,164 | A | 11/1978 | Bachman | |
| 4,286,755 | A * | 9/1981 | Shipman | B05B 1/30 239/530 |
| 4,867,380 | A | 9/1989 | Sibbertsen | |
| 4,907,744 | A * | 3/1990 | Jousson | A61C 17/0202 137/625.44 |
| 6,398,135 | B1 | 6/2002 | Hsiao | |
| 2007/0228190 | A1 * | 10/2007 | Tanner | B05B 1/302 239/526 |

FOREIGN PATENT DOCUMENTS

| | | |
|---|---|---|
| DE | 8805752 U1 | 9/1988 |
| FR | 2550474 A1 | 2/1985 |
| GB | 2145219 A | 3/1985 |

* cited by examiner

*Primary Examiner* — Jason Boeckmann

(74) *Attorney, Agent, or Firm* — Dowell & Dowell, PC

(57) ABSTRACT

The compressed air gun (1) according to the invention comprises a body (2), comprising an upstream conduit (20*b*) that extends along a first axis (X20*b*) and a downstream air ejection conduit (20*a*), and a hole (22), which extends along a second axis (Y22), a closing member (16), which is translatable inside the hole between a closed position and an open position, a trigger (4) that can be manipulated between a released configuration, where it keeps the closing member in the closed position, and a blowing configuration, and means (8) for returning the trigger to its released configuration. This gun further comprises a tubular sleeve (14), which is immobilized inside the upstream conduit (20*b*), which extends parallel to the first axis (X20*b*) and which delimits an air passage, whereas the closing member (16), in the closed position, is suitable for closing off an air passage orifice by forming a sealed contact with the sleeve.

10 Claims, 7 Drawing Sheets

COMPRESSED AIR GUN

Figure 1:
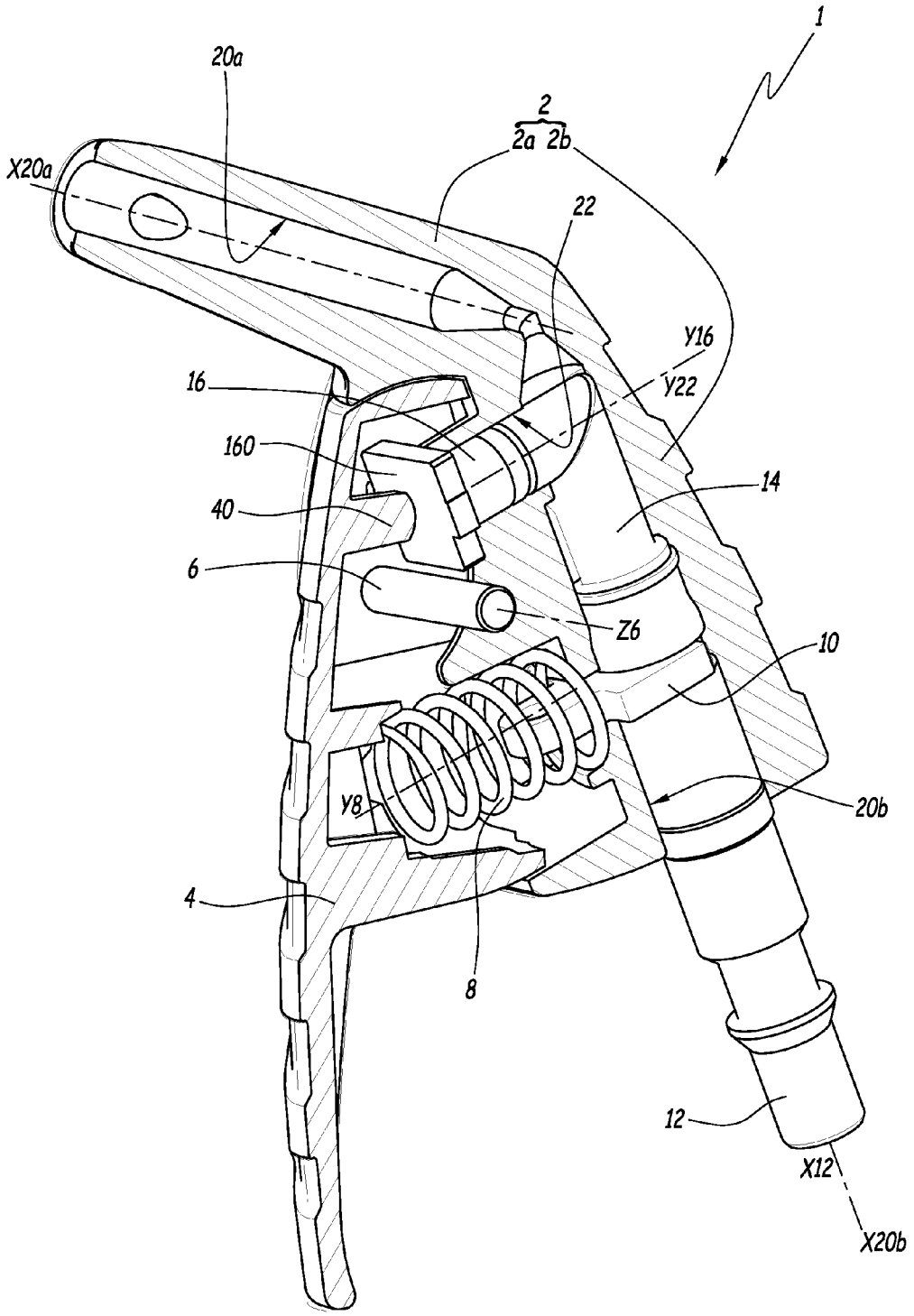

The invention relates to a compressed air gun, for example used in a workshop to expel air on machining parts covered with shavings, or to clean or remove dust from the machines and workstations.

The compressed air guns are is supplied by a pneumatic network comprising various connecting points distributed throughout the workshop. The guns are portable, and the expulsion of air through the gun is activated by pressing a trigger. These guns comprise a selective opening mechanism for the compressed air passage, which is controlled by the trigger. In practice, operators use these guns about ten times per day, which severely biases the opening and closing mechanisms for the compressed air passage.

IT-B-1097346 discloses a compressed air gun comprising a main body, which is passed through by a compressed air passage conduit and which comprises a hole emerging obliquely in that conduit. A closing member is translatable inside the hole between a closed position, where the air passage conduit is closed off tightly, and an open position, where air can circulate. The movement of the closing member is controlled by a trigger, which can be manipulated by the operator between a released configuration, where it keeps the closing member in the closed position, and a blowing configuration, where the air can circulate in the conduit. Furthermore, the gun comprises another valve, which is positioned downstream from the closing member in the compressed air passage conduit and which is provided to block the passage of the air in case of an overpressure along a circular sealing section.

The major drawback of this gun is that the compressed air passage conduit is relatively cluttered by all of the component parts of the two valves and the actuation of the overpressure gate is done against the pressure from the network, which causes the parts to deteriorate more quickly. Furthermore, three channels are necessary to produce the overpressure gate, which involves complex machining of the body of the gun.

Furthermore, DE-A-88 05 752 also discloses a compressed air gun, with which it is possible to alternate between expelling hot air and cold air. This gun comprises a end piece for connecting to the pneumatic network and a passage conduit for the compressed air in the body of the gun. A hole emerges obliquely in the compressed air passage conduit and a closing member is translatable inside the hole. At its end, this closing member bears an end piece configured to close off the inner passage in the hole. When the gun is idle, this end piece bears on a seat to prevent the infiltration of air in the hole along a circular sealing section. The closing member can be moved inside the hole by pulling on a trigger. When the trigger is actuated, the end piece of the closing member unsticks from its seat and the compressed air can infiltrate the hole. This end piece is also subject to an elastic return spring to return to the sealed closing off position when the trigger is released.

In all, four air passage channels are machined in the body of the gun, which is expensive to produce. Furthermore, the gate is opened against the pressure from the compressed air, which, in case of high pressure, may cause an abrupt and difficult opening of the passage and does not make it possible to blow the air gradually and in a controlled manner.

The invention more particularly aims to resolve these drawbacks by proposing a simplified compressed air gun.

To that end, the invention relates to a compressed air gun, comprising:

- a body, comprising a compressed air passage conduit including an upstream conduit that extends along a first axis and a downstream air ejection conduit, and a hole, which extends along a second axis not parallel to the first axis and which emerges in the upstream conduit,
- a closing member, which is translatable, parallel to the second axis, inside the hole between a closed position, where it blocks the passage of the air in the conduit, and an open position, where the air is free to flow between the upstream conduit and the downstream conduit,
- a trigger controlling the movement of the closing member, which can be manipulated between a released configuration, where it keeps the closing member in the closed position, and a blowing configuration, where the closing member is in the open position,
- means for returning the trigger to its released configuration.

According to the invention, this gun further comprises a tubular sleeve, which is immobilized inside the upstream conduit, which extends parallel to the first axis and which delimits an air passage, whereas the closing member, in the closed position, is suitable for closing off an air passage orifice by forming a sealed contact with the sleeve.

Owing to the invention, only the compressed air passage conduit and the hole emerging in that conduit require machining in the body of the gun, which considerably simplifies the manufacturing of the body of the gun. Furthermore, only two internal parts are necessary to provide sealing in the closed position, which are mounted with no screwing operation.

According to advantageous but optional aspects of the invention, a compressed air gun may incorporate one or more of the following features, considered in any technically allowable combination:

- The sleeve delimits a contact surface with the closing member, which is positioned in an oblique plane relative to a plane perpendicular to the first axis.
- The contact surface of the sleeve is an annular surface having elliptical inner and outer contours.
- The sleeve and the closing member each comprise a beveled edge, and the contact surface of the sleeve is delimited on its beveled edge.
- The contact surface of the sleeve comprises a relief, which forms a sealing surface with the closing member when the latter is in the closed position.
- The gun comprises a junction tail piece for connecting to a compressed air supply tube, that junction tail piece being suitable for being fastened to the body of the gun and being able to cooperate tightly with one end of the sleeve opposite the hole.
- The gun comprises means for immobilizing the junction tail piece in the upstream conduit, which comprise a staple that is immobilized in the housing of the body by the return means of the trigger and which cooperates with a peripheral groove of the junction tail piece to block the sliding of the junction tail piece inside the upstream conduit.
- The closing member is kept in the closed position by a push-piece of the trigger, which bears against one end of the closing member opposite the upstream conduit and the push-piece acts on the closing member along the second axis of the hole.
- The gun comprises means for immobilizing the rotation of the sleeve inside the upstream conduit, which comprise a longitudinal rib supported by the sleeve and a slot for receiving that rib arranged in the body of the gun.

The trigger comprises means for translating the closing member toward its open position, those means comprise at least one receiving housing for receiving a base protruding from the closing member and the protruding base is positioned at an end opposite the upstream conduit and is engaged in the housing(s) of the trigger with axial play, measured parallel to the second axis of the hole, between the base of the closing member and a contact edge of the housing(s).

The receiving hole of the closing member extends along its second axis perpendicular to the first axis of the upstream conduit.

The sleeve is made from an elastic material, in particular plastic or rubber.

Figure 2:
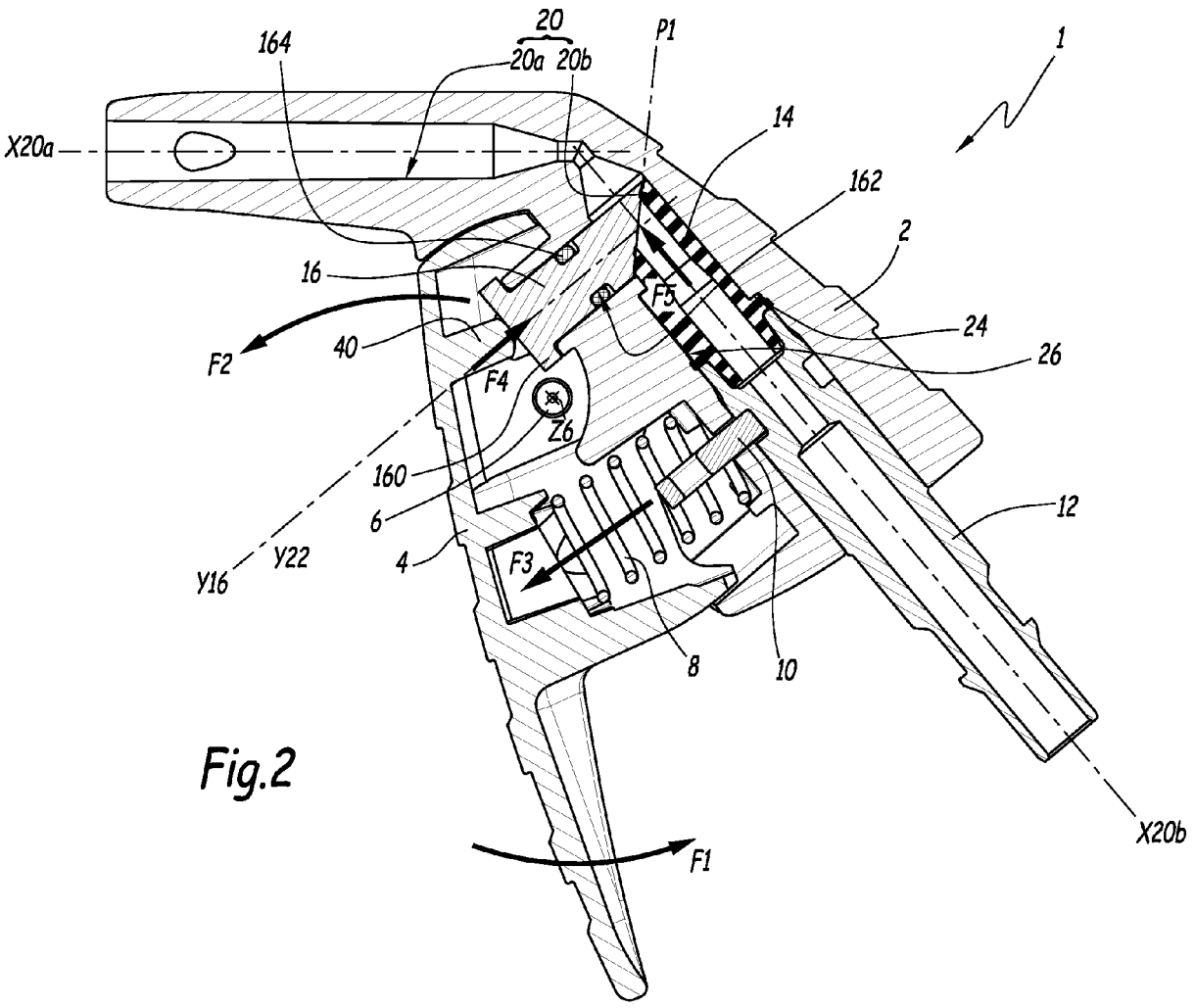
Figure 3:
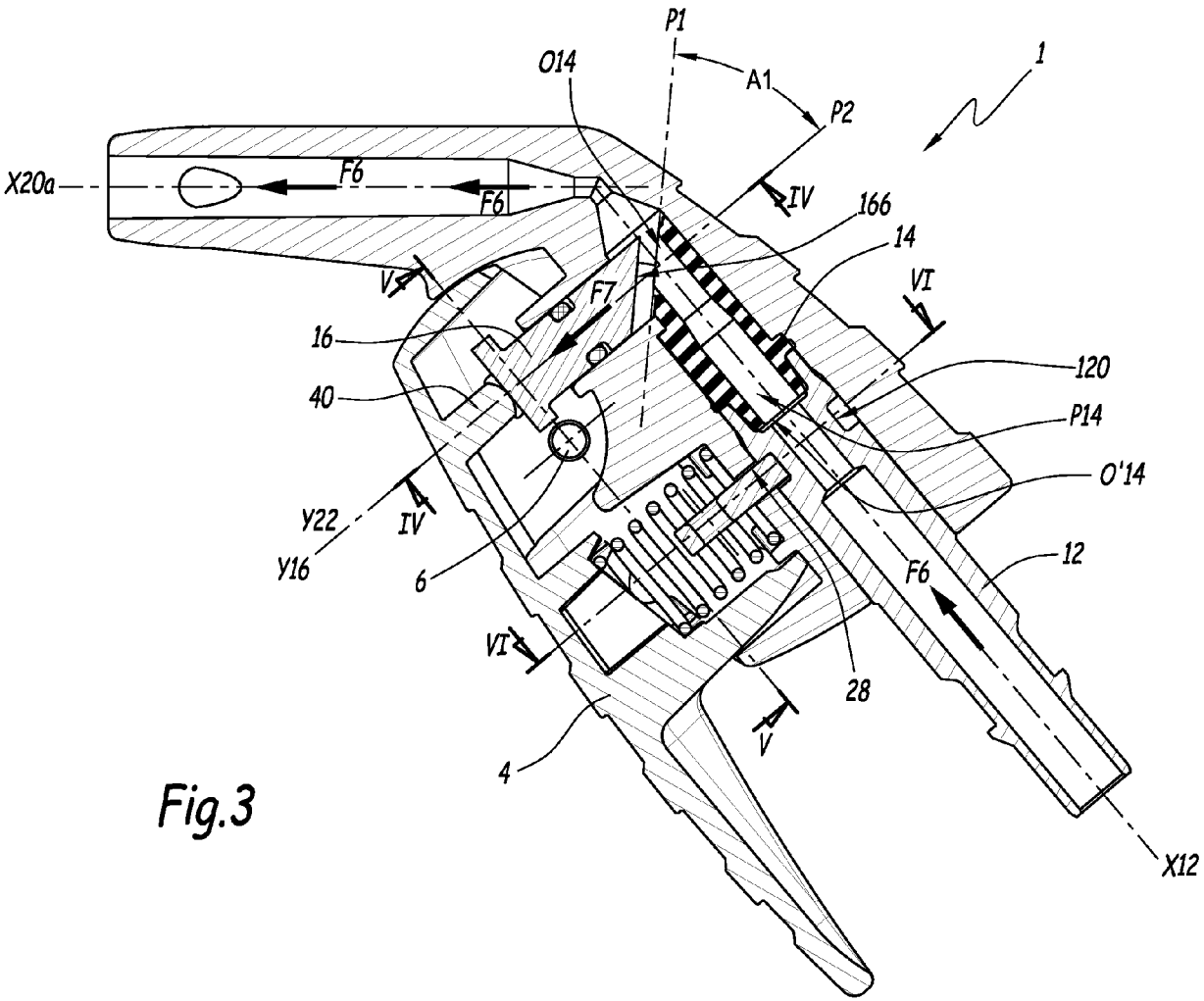
Figure 4:
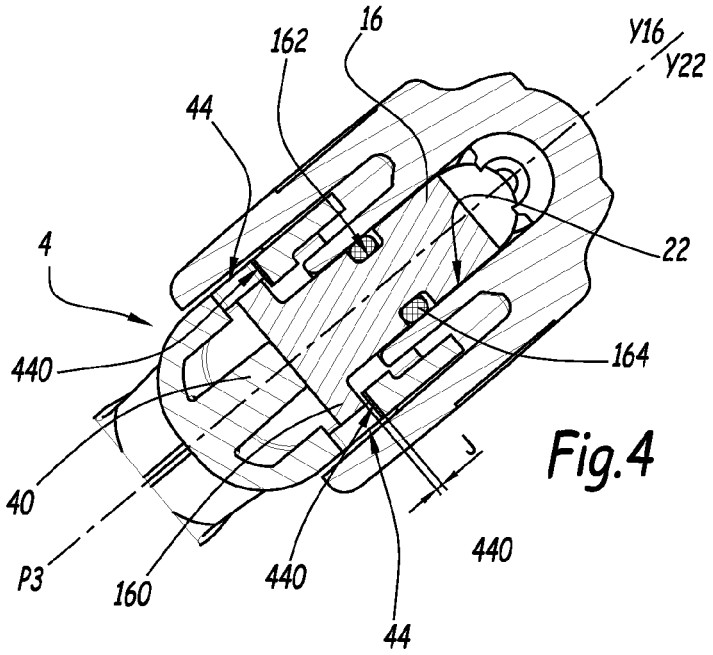
Figure 5:
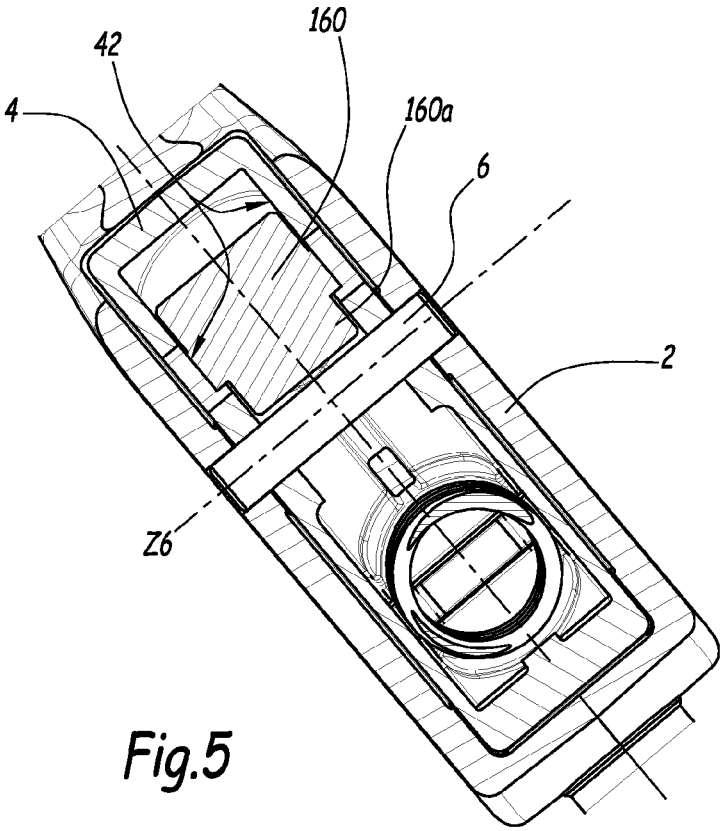
Figure 6:
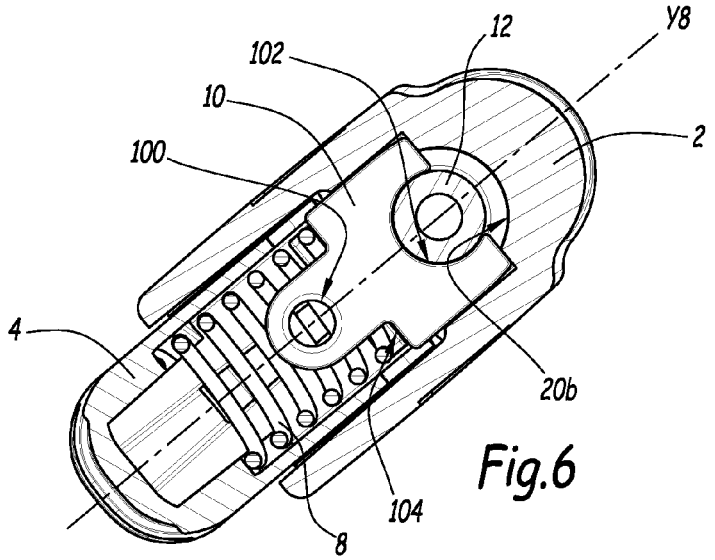
Figure 7:
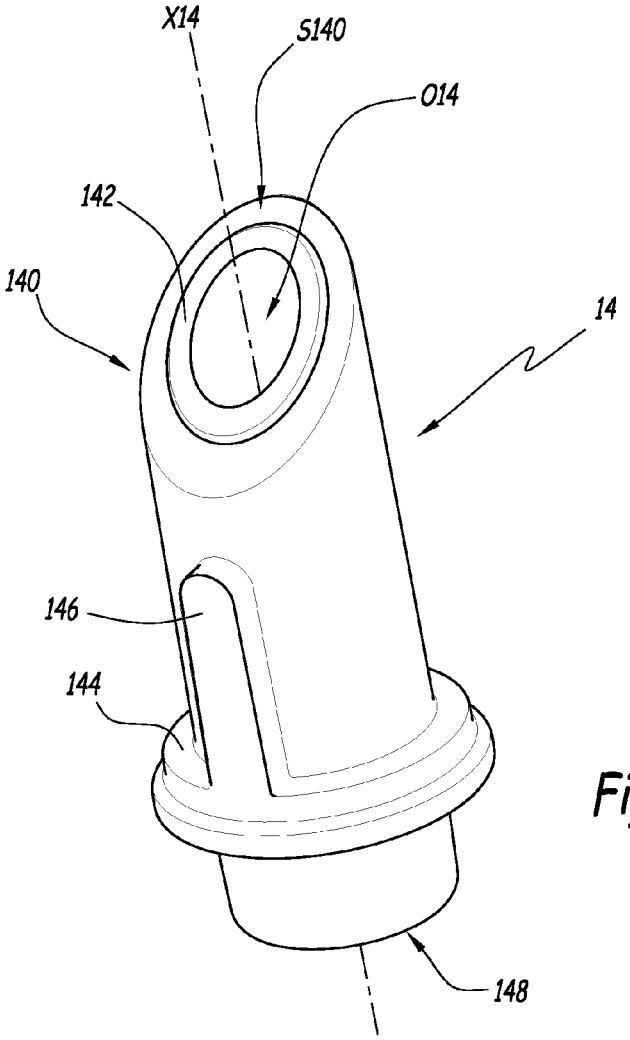
Figure 8:
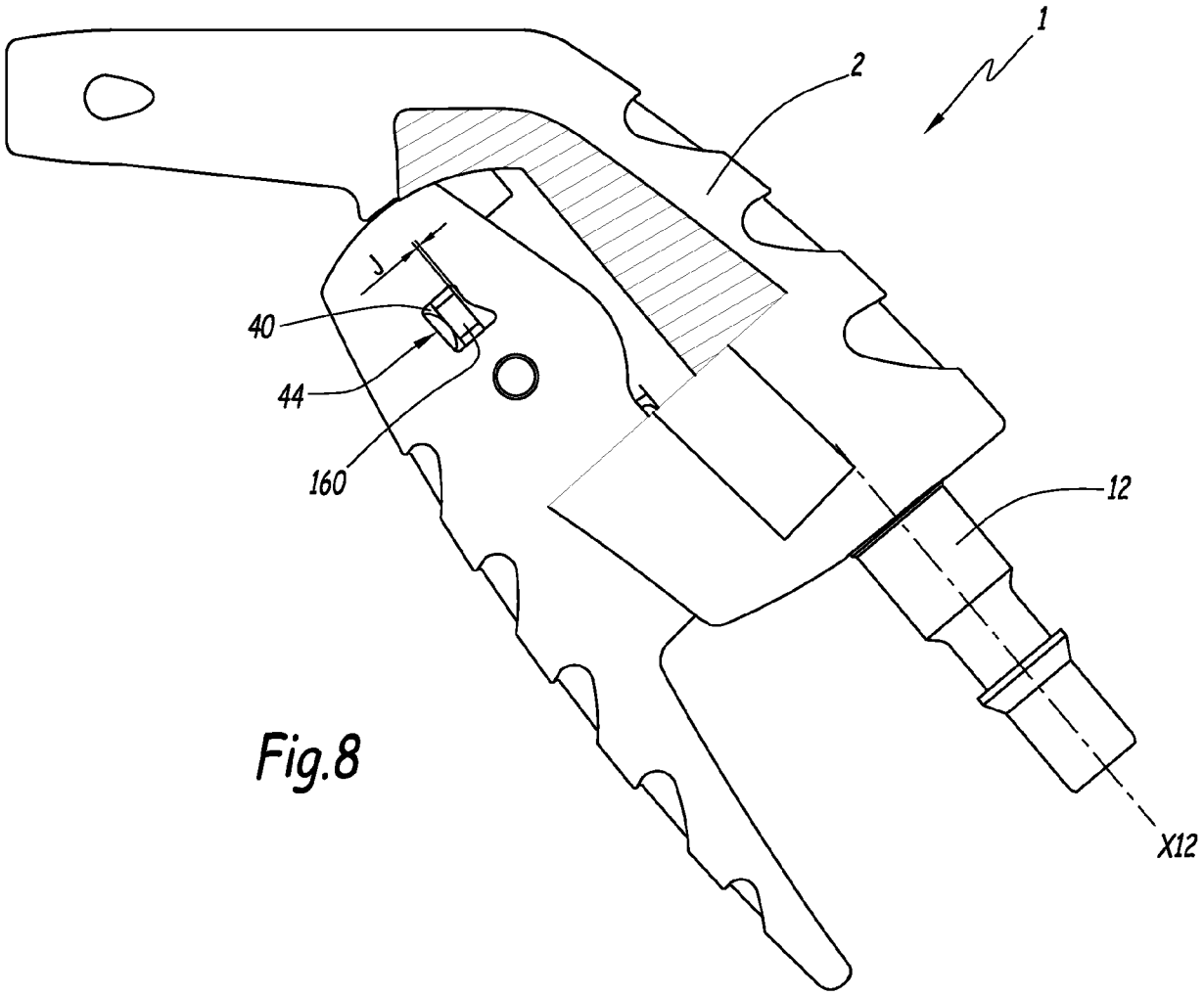
Figure 10:
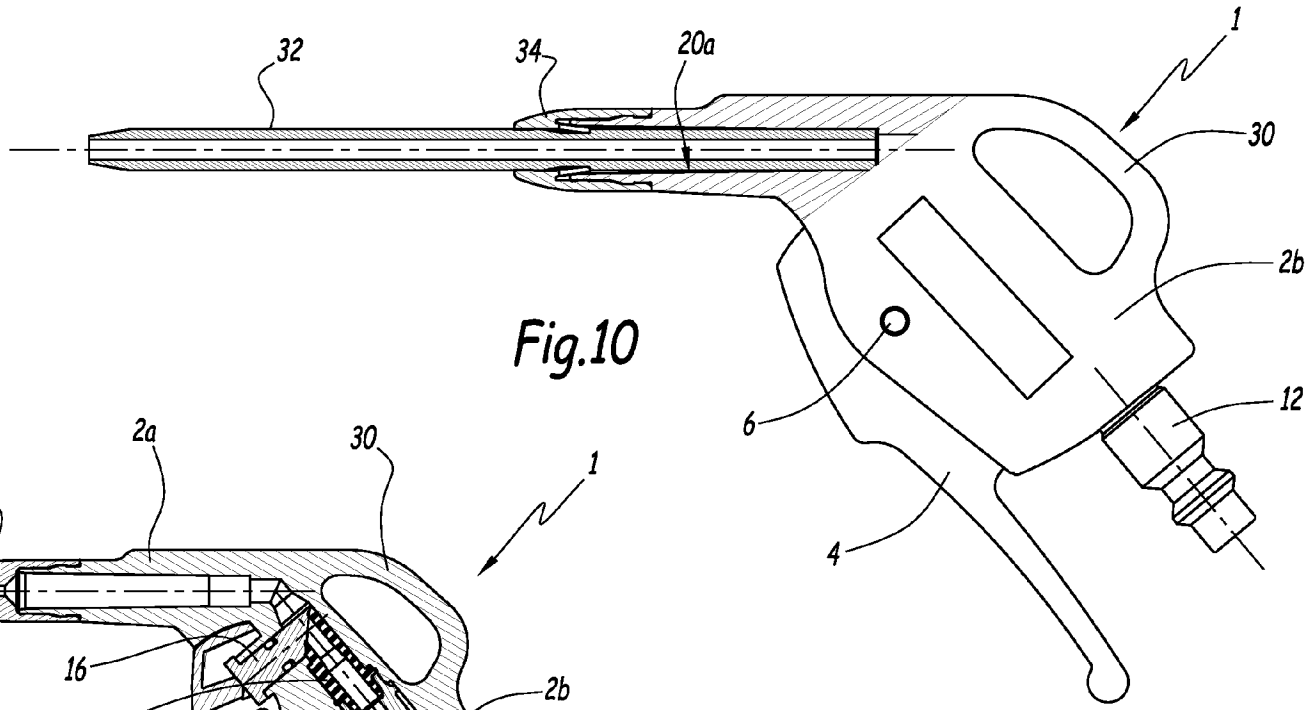
Figure 9:
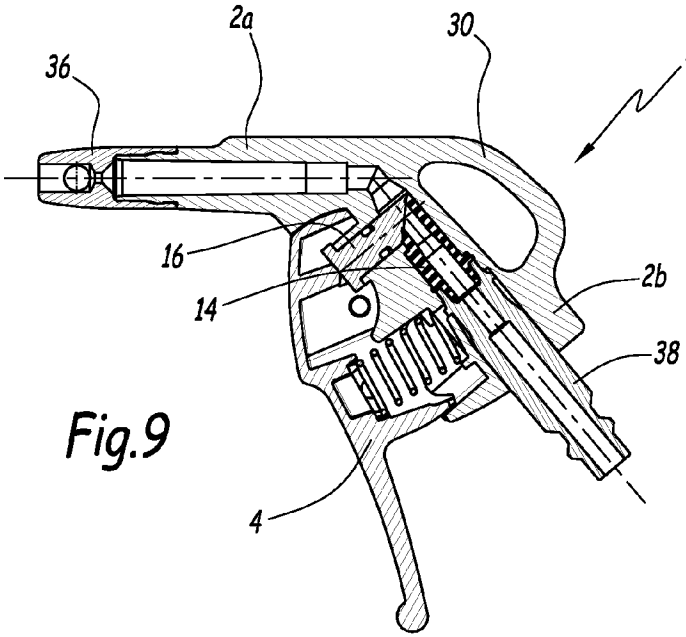

The invention and other advantages thereof will appear more clearly in light of the following description of three embodiments of a compressed air gun according to its principle, provided solely as an example and done in reference to the drawings, in which:

FIG. 1 is a perspective view of a compressed air gun according to the invention, in which a body of the gun is shown in half-section, FIG. 2 is a sectional view of the gun of FIG. 1, in which the gun is shown in the idle, or unused, configuration, FIG. 3 is a sectional view similar to FIG. 2, in which the gun is shown in a blowing configuration, FIG. 4 is an enlarged sectional view along line IV-IV of FIG. 3, FIG. 5 is an enlarged sectional view along line V-V in FIG. 3, FIG. 6 is an enlarged sectional view along line VI-VI in FIG. 3, FIG. 7 is a perspective view of a sleeve belonging to the gun of the preceding figures, FIG. 8 is a perspective view of the gun from the preceding figures, which is shown with one part removed so as to see a movement play of a closing member inside the gun, FIG. 9 is a sectional view similar to FIG. 2 of a compressed air gun according to a second embodiment of the invention, and FIG. 10 is a partial sectional view, showing a third embodiment of a compressed air gun according to the invention.

FIG. 1 shows a compressed air gun 1, used to expel air on machining parts covered with shavings, to clean or remove dust from machines and workstations.

In this document, the "upstream" and "downstream" directions must be interpreted relative to the flow of air circulating in the gun 1.

This gun 1 looks like a gun and comprises a main body 2. The body 2 is bent, i.e., it comprises an upstream part 2*b* that extends in a slightly deviated direction relative to a downstream part 2*a*. During operation, the downstream part 2*a* is oriented toward the part to be cleaned and the upstream part 2*b* is oriented toward a compressed air source.

The body 2 is crossed through by a compressed air passage conduit 20. That conduit 20 comprises a downstream conduit 20*a* and an upstream conduit 20*b* that are delimited in the downstream part 2*a* and the upstream part 2*b* of the body 2. The downstream conduit 20*a* is an air ejection conduit, while the upstream conduit 20*b* is an air injection conduit. The conduits 20*a* and 20*b* respectively extend along axes X20*a* and X20*b* that are concurrent and form an obtuse angle relative to one another, approximately equal to 120°. The body 2 also defines a hole 22 that emerges in the conduit 20*b*. In particular, the hole 20 extends along an axis Y22 perpendicular to the axis X20*b*, i.e., not parallel to the axis X20*b*. The hole 22 emerges at the downstream end of the conduit 20*b*, i.e., close to the upstream end of the conduit 20*a*. The hole 22 is a bore, i.e., it comprises a cylindrical wall.

A trigger 4 is mounted articulated relative to the body 2. This trigger 4 makes it possible to trigger the expulsion of air by the gun 1. The trigger is like a lever that can be manipulated with one hand. The trigger 4 is rotatably mounted around a shaft 6 that extends along an axis Z6. The axis Z6 therefore forms an axis of rotation of the trigger 4 relative to the body 2. The axis Z6 is perpendicular both to the axes X20*b* and Y22. In FIG. 1, the trigger 4 is shown in a released configuration, where the expulsion of air through the gun 1 is blocked. By pulling on the trigger 4, the trigger 4 enters a blowing configuration, where the air is expelled from the gun 1.

The gun 1 can be grasped by an operator with the right or left hand indifferently. When the operator picks it up, he places the palm of his hand against the part 2*a* of the body 2 and places his finger around the trigger 4.

Return means keep the trigger 4 in the released configuration. These return means include a helical spring 8. The trigger 4 is provided to tilt around the shaft 6 against the elastic force exerted by that spring 8. In other words, the spring 8 is compressed when the operator pulls on the trigger 4. The spring 8 extends between the trigger 4 and the body 2. It is centered on an axis Y8 that is substantially particular to the axis X20*b*.

A sleeve 14 is immobilized inside the conduit 20*b* of the body 2. This sleeve 14 is better visible in FIG. 7, where it is shown alone. The sleeve 14 is hollow and comprises two opposite orifices O14 and O'14 for passage of the compressed air. The orifices O14 and O'14 are positioned at the downstream and upstream ends of the sleeve 14, respectively. The sleeve 14 is globally tubular and is centered on an axis X14 that is parallel to, or even combined with the axis X20*b* in the configuration installed in the conduit 20*b*. The sleeve 14 therefore extends parallel to the axis X20*b* and comprises a beveled edge 140. This edge 140 is a downstream edge of the sleeve 14 and comprises a surface S140. This surface S140 is an annular surface with elliptical outer and inner contours. The surface S140 of the edge 140 comprises a relief or raised portion 142, which extends around the orifice O14. This relief 142 delimits the contour of the orifice O14. During operation, the compressed air passing in the conduit 20 circulates inside the sleeve 14. The sleeve therefore delimits an air passage P14 that extends between the two orifices O14 and O'14 of the sleeve 14. The air passage P14 is a central passage, or internal passage, of the sleeve 14, which connects the upstream conduit and the downstream conduit of the gun. The orifices O14 and O'14 constitute the opposite ends of the passage P14.

Furthermore, the sleeve 14 is elastically deformable, in particular at the surface S140 and the relief 142. The sleeve 14 is preferably made from an elastic material, such as plastic or rubber. It may also be made from a rigid material and comprise, at the beveled edge 140, an elastic ring in place of the relief 142.

The sleeve 14 comprises a positioning collar 144 for positioning the sleeve 14 inside the conduit 20*b*. In fact, in the assembled configuration of the sleeve 14 and the conduit 20*b*, the collar 144 abuts against a shoulder 24 of the body 2. This shoulder 24 is oriented toward the inside of the conduit 20*b* and causes a reduction in the section of the conduit 20*b* in the downstream direction. Thus, the sleeve 14 is immobilized in translation. The sleeve 14 also comprises a rib 146 that extends, parallel to the axis X14, from the collar 144 and toward the beveled edge 140. This rib 146 is an angular indexing rib of the sleeve 14 inside the conduit 20*b*. In fact, this rib 146 is provided to be inserted into a corresponding slot 26 arranged in the conduit 20*b*. Likewise, the sleeve 14 is immobilized in rotation inside the conduit 20*b* in the required angular position.

The sleeve 14 comprises an upstream end 148 for connecting with a junction tail piece 12: this end of the sleeve, opposite the hole 22, can cooperate tightly with the inner surface of the junction tail piece 12 by fitting of the two elements. The junction tail piece 12 makes it possible to connect the gun 1 to a compressed air supply hose, which is not shown in figures. The connection between the junction tail piece 12 and the compressed air supply hose is a male/female type connection. The junction tail piece 12 extends along an axis X12 that is parallel to, or even combined with, the axis X20*b*. The junction tail piece 12 protrudes from the body 2 and is immobilized inside the conduit 20*b* using a staple 10, which makes it possible to fasten it to the body 2.

As shown in FIG. 6, the staple 10 has a symmetrical shape relative to the axis Y8. The staple 10 "straddles" the junction tail piece 12, i.e., it is mounted around a peripheral groove 120 hollowed out in the junction tail piece 12. More specifically, it comprises a round wall 102, which is complementary to the groove 120 and surrounds more than half of the circumference of the groove 120. In this way, the staple 10 and the junction tail piece 12 are secured in translation along the axis X12 due to the elasticity of the staple. However, as shown in FIG. 3, the staple 10 is inserted with slight play in a through housing 28 formed in the body 2. This housing 28 extend parallel to the axis Y8 and makes it possible to immobilize the staple 10 in translation along the axis X12. Consequently, the staple 10 prevents the junction tail piece 12 from sliding in the conduit 20*b*. The staple 10 also comprises two shoulders 104, which are oriented toward the trigger 4, opposite with respect to the rounded wall 102. In the direction of the trigger 4, the shoulders 104 reduce the width of the staple 10, that width being measured parallel to the axis Z6. One end of the spring 8 bears on the shoulders 104, the other end of the spring 8 bearing against two shoulders of the trigger 4. Thus, the staple 10 is kept pressed in its housing 28, i.e., against the junction tail piece 12, by the elastic force exerted by the spring 8. In other words, the rounded wall 102 is kept in the groove 120.

A closing member 16 is positioned inside the hole 22 of the body 2. This closing member 16, also called "piston", is globally cylindrical and extends along an axis Y16 parallel to, or even combined with, the axis Y22 on which the bore 22 is centered. The closing member 16 is translatable parallel to the axis Y22 between a closed position, where it blocks the passage of the air in the conduit 20, and an open position, where it is free to circulate between the upstream conduit 20*b* and the downstream conduit 20*a*. In the open position, which is a blowing position, the gun 1 expels air.

The closing member 16 is provided to cooperate with the sleeve 14 in the closed position. To that end, the member 16 comprises a beveled edge 166 that is complementary to the beveled edge 140 of the sleeve 14, i.e., the edge 166 is configured to bear flat against the edge 140 in the closed position. The edge 166 is a solid elliptical edge, configured to come into tight contact with the edge 140 of the sleeve 14 in the closed position. More specifically, the beveled edge 166 of the closing member 16 is suitable for closing off the orifice O14 of the passage P14 in the closed position, forming a tight contact with the sleeve 14. In this position, the compressed air is no longer free to circulate between the upstream conduit and the downstream conduit. The surface S140 of the edge 140 therefore forms a contact surface between the sleeve 14 and the member 16.

Although not shown, the invention provides that the edge 166 of the closing member 16 and the edge 140 of the sleeve 14 can be concave, convex or otherwise irregular, but complementary to cooperate and form a tight contact surface in the closed position of the closing member 16. These configurations of edges 166 and 140 have a contact surface globally positioned in a plane P1 that is oblique relative to a plane P2 perpendicular to the conduit 20*b*.

The contact between the sleeve 14 and the member 16 is even tighter in light of the presence of the relief 142, which guarantees the deformation of the elastic sleeve at the junction tail pieces of the orifice O14 over its entire periphery. In fact, during the contact between the sleeve 14 and the closing member 16, the sleeve 14 is elastically biased in compression in its axial direction X14 owing to the presence of the raised portion 142. Thus, the sleeve 14, seeking to regain its initial shape by elastic return, exerts an opposing force on the closing member 16 oriented parallel to the axis X14, which provides tight contact with the member 16. The closing member therefore has, by its, a deformable contact surface that produces sealing over the entire periphery of the orifice O14.

The contact surface S140 between the sleeve 14 and the closing member 16 is an annular surface, which ensures optimal sealing. The surface has elliptical inner and outer contours and is positioned very close to a plane P1, or in a plane P1 that is oblique relative to a plane P2 perpendicular to the conduit 20*b*. More specifically, the plane P1 forms an angle A1 with the plane P2 approximately equal to 45°. However, the angle A1 is in practice comprised between 20° and 70°.

The inner contour of the annular surface is like an ellipse with a width a and a length b for a sleeve whose passage diameter has value a. For sleeve whereof the plane P1 is at 45°, the length of the ellipse will be equal to $b=a\sqrt{2}$. In this configuration, which is a preferred configuration, the contact surface will be at least equal to the surface of the inner ellipse, such that $a/2\times b/2\times\Pi$, or $a^2\times\sqrt{2}\times\Pi\times0.25$. In the known configurations, where the tightness is formed perpendicular to the fluid passage, whereof the circular passage diameter has value a, the sealing surface is equal to $(a/2)^2\times\Pi=a^2\times\Pi\times0.25$. For a same passage diameter, the sealing surface produced at the end of the sleeve with a 45° angle is therefore multiplied by $\sqrt{2}$, i.e., an increase of approximately 41%. This configuration thus makes it possible to increase the sealing perimeter non-negligibly without increasing the bulk of the passage conduits and to provide optimal deformation of the sleeve to facilitate the tightness of the closing member.

The closing member 16 comprises a base 160 that is opposite the beveled edge 166 along the axis Y16. The base 160 protrudes peripherally relative to the rest of the body of the closing member 16. It is globally rectangular and bears against a push-piece 40 of the trigger 4. The push-piece 40 is a protruding part of the trigger 4 oriented toward the body 2.

The closing member 16 comprises, approximately in the middle, a peripheral groove 162 for receiving a sealing gasket 164. This sealing gasket 164 makes it possible to prevent air from infiltrating the hole 22 during operation. A single sealing gasket is therefore used in the construction of the gun 1, which facilitates assembly.

As shown in FIG. 4, the rectangular base 160 of the closing member 16 is partially engaged in two through housings 44 delimited in the trigger 4. The housings 44 are opposite one another relative to a plane P3 of the gun and in a direction parallel to the axis Z6. The plane P3 is a plane perpendicular to the plane P2 and the axis Z6, which contains the axes Y16 and Y22. The plane P3 is also the cutting plane of the gun 2 in FIGS. 1 and 3. These housings 44 are rectangular openings positioned on either side of the member 16. They have a width, measured parallel to the axis Y16, that is greater than the thickness of the base 160. Thus, a contact play J exists between the base 160 and a contact edge 440 of the housings 44. The edge 440 is the edge of the housings 44 closest to the upstream conduit 20*b* and which is opposite the push-piece 40. The edge 440 is the edge that may come into contact with the base 160 of the member 16 during the operation of the trigger 4. In the example of the figures, the edge 440 is the edge of the housings 44 closest to the base 160, but a different arrangement may be adopted. The contact play J is an axial play that evolves based on the arrangement of the base 160 in the housings 44. In the closed position, this play J is approximately 0.5 mm.

The axial play J that the closing member 16 has inside the hole 22 allows it to acquire optimal contact, i.e., the tightest possible contact, with the sleeve 14 in the closed position.

As explained above, in the event the sleeve 14 is rigid, it has an elastic ring at its beveled edge 140. This elastic ring is compressed during contact with the closing member 16 to obtain gripped contact between the two parts, and maximum sealing.

Furthermore, the closing member 16 is guided in translation in the conduit 22. In fact, as shown in FIG. 5, the rectangular base 160 is received in a cavity 42 of the trigger 4. This cavity 42 globally hugs the shape of the base 160, such that the closing member is immobile in rotation around the axis Y16 inside the hole 22. Furthermore, the base 160 comprises two shoulders, which delimit a portion 160*a* with a width, measured parallel to the axis Z6, narrowed relative to the rest of the base 160. This allows correct indexing of the closing member 16 inside the hole 22, i.e., angular positioning of the closing member 16 so that its beveled edge 166 is in perfect flat contact with the edge 140 of the sleeve 14 in the closed position.

When idle, i.e., in the configuration of FIGS. 1 and 2, the spring 8 exerts a force F3 oriented along the axis Y8 on the trigger 4. This elastic load force F3 tends to tilt the trigger 4 around the shaft 6 in the clockwise direction in FIG. 2. However, the movement of the trigger 4 is limited in that direction by the body 2. Consequently, the push-piece 40 presses on the closing member 16 in a direction F4 oriented parallel to the axis Y16, and in the direction of the conduit 20*b*. The bearing force F4 of the push-piece 40 on the closing member 16 makes it possible to keep the closing member 16 in the closed position under the pressure of the compressed air. In fact, the compressed air coming from the junction tail piece 12 exerts a pressure F5 on the beveled edge 166 of the closing member 16 and causes pressure forces on the contact surface 166 of the closing member 16 that generate a force component along the axis Y16 toward the push-piece 40. The closing member 16 behaves like a wedge, i.e., the pressure exerted by the compressed air in the conduit 20*b* on the member 16 tends to move the closing member 16 in a direction opposite the conduit 20 and along the axis Y16. However, the bearing force F4 of the push-piece 40 is preponderant before the pressure F5 of the compressed air exerted on the closing member 16, such that the trigger 4 can only tilt toward the body 2, i.e., in blowing configuration.

To expel compressed air, the user pulls on the trigger 4 while gripping the handle. Thus, the trigger 4 leaves its released configuration and pivots around the shaft 6 against the elastic load force F3 of the spring 8, as shown by arrows F1 and F2 in FIG. 2. By pivoting, the push-piece 40 moves away from the closing member 16, i.e., it no longer exerts a retaining force F4. Thus, if the pressure of the compressed air injected in the conduit 20 is sufficient, the closing member 16 is translated in a direction F7. This direction F7 is oriented parallel to the axis Y16 due to the presence of the beveled edge 166, which acts as a corner. The movement of the closing member 16 in the direction F7 causes a break in the tight contact between the closing member 16 and the sleeve 14. The air can circulate, as shown by the arrows F6 in FIG. 3.

However, in the event the pressure of the air injected the conduit 20*b* is insufficient, the closing member 16 is nevertheless driven by the trigger 4 in translation in direction F7. In fact, when the trigger 4 tilts toward the body 2, the play J existing between the base 160 and the closing member 16 of the housings 44 of the trigger 4 is reacted and the base 160 comes into contact with the edges 440 of the housings 44, which drives the closing member 16 in translation. The advantage of using an inclined closing edge 166 of the conduit 20 is that it ensures that the movement of the closing member 16 will not be done in opposition with the pressure from the compressed air injected into the junction tail piece 12. Thus, the pressure of the compressed air accompanies the movement of the closing member 16 between its closed position and its open position. The operator therefore does not need to force the trigger 4 to press it, and the gun 1 is easy to manipulate.

In other words, the forces necessary to open the conduit 20 must not overcome the pressure force F5 exerted by the air upstream, and the operator does not act against the pressure from the network when he wishes to expel air via the gun. As a result, the blowing can be done in a gradual and controlled manner.

Gripping the trigger 4 brings the gun 1 into the configuration of FIG. 3. The trigger 4 is then in the blowing configuration, where the air circulates in the conduit 20.

When the operator has finished using the gun 1, he releases the pressure on the trigger 4. The trigger 4 then returns to its released configuration under the elastic return force F3 of the spring 8. The spring 8 relaxes. Thus, the trigger 4 pivots around the shaft 6 and the push-piece 40 presses on the closing member 16 to translate it inside the hole 22, until it comes into contact with the beveled edge 140 of the sleeve 14. The sleeve 14 and the closing member 16 are then once again in tight contact and the passage of air in the orifice O14 of the sleeve 14 is blocked.

FIG. 9 shows a second embodiment of the compressed air gun according to the invention. In the interest of concision, only the elements that are different from the first embodiment are described below. Furthermore, identical elements or elements that function similarly relative to the gun of the first embodiment bear the same numerical references, while the additional elements or elements that work differently relative to those of the first embodiment bear other numerical references.

The compressed air gun 1 of FIG. 9 differs from that of the first embodiment in that the body 2 comprises a handle 30 for manipulating the compressed air gun 1. This handle 30 facilitates holding of the gun 1. Furthermore, the gun 1 comprises a body 2 having a bent part 2*a* on which a nozzle 36 is snapped. Snapping means that it may involve an elastic locking mechanism for mounting a pin or peripheral claws of the nozzle configured to penetrate a curved or bent slot of the body. The nozzle 36 can also be screwed to the end of the bent part 2*a* of the body 2. Furthermore, the gun 1 of this embodiment comprises a junction tail piece 38 that is also snapped inside the body 2. The advantage of this embodiment is that the nozzle is interchangeable and in particular makes it possible to adapt the form of the jet.

FIG. 10 shows a third embodiment of a compressed air gun 1. In this third embodiment, the gun 1 comprises a body 2 also comprising a handling handle 30. Furthermore, the gun 1 comprises a compressed air injection nozzle that is made in two parts. A first part 34 is snapped on a bent part 2*a* of the body 2, and a second part 32 is inserted into a conduit 20*a* of the bent part 2 and is immobilized by the part 34 using retaining means belonging to the part 34. In an alternative that is not shown, the junction tail piece 12 forms a single piece with the body 2.

In an alternative that is not shown, the housings 44 are blind.

In an alternative that is not shown, the closing member 16 can be movable in a hole that emerges in the conduit 20*b* upstream relative to the sleeve 14, and closes off the upstream edge 148 of the sleeve 14 and not the downstream edge 140, as previously described.

In an alternative that is not shown, the closing member 16 has slight rotational play around its axis X16, which may make it possible to improve contact with the sleeve 14, i.e., to react any coplanarity defect between the contact surfaces of the sleeve 14 and the member 16.

The technical features of the alternatives and embodiments considered above may be combined to create new embodiments of the invention.

The invention claimed is:

1. A compressed air gun, comprising:

a body, comprising a compressed air passage conduit including an upstream conduit that extends along a first axis and a downstream air ejection conduit, and a hole which extends along a second axis not parallel to the first axis and which emerges in the upstream conduit, a closing member, which is translatable, parallel to the second axis, inside the hole between a closed position, where the closing member blocks passage of air in the upstream conduit, and an open position, where the air is free to flow between the upstream conduit and the downstream conduit, a trigger controlling the movement of the closing member, which can be manipulated between a released configuration, where the trigger keeps the closing member in the closed position, and a blowing configuration, where the closing member is in the open position, return means for returning the trigger to the released configuration, a tubular sleeve immobilized inside the upstream conduit and extending parallel to the first axis, the tubular sleeve including two opposite orifices positioned at downstream and upstream ends of the sleeve and between which extends an air passage, wherein the closing member, in the closed position, is suitable for closing off the orifice of the air passage at the downstream end of the sleeve by forming a sealed contact with the downstream end of the sleeve and wherein the sleeve delimits a contact surface with the closing member, which is positioned in an oblique plane relative to a plane perpendicular to the first axis and wherein the contact surface of the sleeve is an annular surface having elliptical inner and outer contours.

2. The gun according to claim 1, wherein the sleeve and the closing member each include a beveled edge, and wherein the contact surface of the sleeve is delimited on the beveled edge of the sleeve.

3. The gun according to claim 1, wherein the contact surface of the sleeve includes a relief, which forms a sealing surface with the closing member when the closing member is in the closed position.

4. The gun according to claim 1, including a junction tail piece for connecting to a compressed air supply tube, the junction tail piece being suitable for being fastened to the body of the gun and being able to cooperate with the upstream end of the sleeve opposite the hole.

5. The gun according to claim 4, including means for immobilizing the junction tail piece in the upstream conduit, which include a staple that is immobilized in a housing of the body by the return means of the trigger and which cooperates with a peripheral groove of the junction tail piece to block the sliding of the junction tail piece inside the upstream conduit.

6. The gun according to claim 1, wherein the closing member is kept in the closed position by a push-piece of the trigger which bears against one end of the closing member opposite the upstream conduit and wherein the push-piece acts on the closing member along the second axis of the hole.

7. The gun according to preceding claim 1, including immobilizing means for immobilizing rotation of the sleeve inside the upstream conduit, which includes a longitudinal rib supported by the sleeve and a slot for receiving the longitudinal rib arranged in the body of the gun.

8. The gun according to claim 1, wherein the trigger includes translation means for translating the closing member toward the open position, wherein the translation means includes a base protruding from the closing member and wherein the protruding base is positioned at an end of the closing member opposite the upstream conduit and is engaged in housings defined by the trigger with axial play, measured parallel to the second axis of the hole, between the base of the closing member and contact edges of the housings.

9. The gun according to claim 1, wherein the hole for receiving the closing member extends along the second axis which is perpendicular to the first axis of the upstream conduit.

10. The gun according to claim 1, wherein the sleeve is made from an elastic material selected from plastic and rubber elastic materials.

* * * * *